US007404220B2

(12) United States Patent
Kemp

(10) Patent No.: US 7,404,220 B2
(45) Date of Patent: Jul. 29, 2008

(54) BED FRAME WITH AN ELASTICALLY SUSPENDED MATTRESS SUPPORT

(75) Inventor: Stewart Kemp, East Sussex (GB)

(73) Assignee: Formfollows Limited, East Sussex (GB)

( * ) Notice: Subject to any disclaimer, the term of this patent is extended or adjusted under 35 U.S.C. 154(b) by 0 days.

(21) Appl. No.: 10/526,344

(22) PCT Filed: Sep. 2, 2003

(86) PCT No.: PCT/GB03/03804

§ 371 (c)(1),
(2), (4) Date: Nov. 7, 2005

(87) PCT Pub. No.: WO2004/019732

PCT Pub. Date: Mar. 11, 2004

(65) Prior Publication Data

US 2006/0150319 A1 Jul. 13, 2006

(30) Foreign Application Priority Data

Sep. 2, 2002 (GB) ..... 0220349.5

(51) Int. Cl.
*A47C 19/00* (2006.01)

(52) U.S. Cl. ..... 5/104; 5/244; 5/412; 5/210

(58) Field of Classification Search ..... 5/124, 5/126, 189, 190, 210, 412, 244, 10
See application file for complete search history.

(56) References Cited

U.S. PATENT DOCUMENTS

| | | | | | |
|---|---|---|---|---|---|
| 159,086 | A * | 1/1875 | Fowler et al. | ..... | 5/244 |
| 676,544 | A * | 6/1901 | Martin | ..... | 5/210 |
| 1,444,726 | A * | 2/1923 | Broyles | ..... | 5/210 |
| 2,377,464 | A * | 6/1945 | Tucker | ..... | 5/244 |
| 3,037,215 | A | 6/1962 | Pile | ..... | 5/111 |
| 3,231,304 | A * | 1/1966 | Coup | ..... | 296/190.02 |
| 3,524,673 | A * | 8/1970 | Beeson et al. | ..... | 296/156 |
| 3,698,022 | A | 10/1972 | Knight | ..... | 5/118 |
| 4,419,778 | A * | 12/1983 | Griffith | ..... | 5/244 |
| 4,713,851 | A * | 12/1987 | Rosquist | ..... | 5/118 |
| 4,868,939 | A * | 9/1989 | Tagtow | ..... | 5/103 |
| 4,977,631 | A | 12/1990 | Bretz | ..... | 5/118 |

FOREIGN PATENT DOCUMENTS

| | | |
|---|---|---|
| DE | 297 09 262 U1 | 10/1997 |
| DE | 198 56 039 A1 | 9/1999 |
| DE | 299 18 867 U1 | 3/2000 |
| FR | 751.668 | 6/1933 |
| GB | 411578 | 6/1934 |
| GB | 1067984 | 5/1967 |
| GB | 2356134 A | 5/2001 |

* cited by examiner

*Primary Examiner*—Michael Trettel
(74) *Attorney, Agent, or Firm*—Ohlandt, Greeley, Ruggiero & Perle, L.L.P.

(57) ABSTRACT

A bed has a frame and a mattress support. The mattress support is suspended from the bed frame by a plurality of elastic supports. The mattress support can move in a downward direction when weight is applied to the mattress support.

25 Claims, 5 Drawing Sheets

2

BED FRAME WITH AN ELASTICALLY SUSPENDED MATTRESS SUPPORT

FIELD OF THE INVENTION

The present invention relates to a bed and in particular to a bed frame for supporting a mattress.

DISCUSSION OF THE BACKGROUND ART

Bed frames and mattresses are well known arrangements for providing a surface on which a person can sleep or rest. Many different structures have been proposed to provide a suitable resting surface and support to the sleeping person. These structures conventionally include a rigid base or frame on which a mattress can rest.

However, the above beds suffer from the problem that the comfort of the bed is usually provided by the mattress, which is typically sprung to be able to support the weight of the user. The springs of a mattress will lose their resilience over time, causing discomfort to the user. Furthermore, the springs in a particular mattress may be suitable for the comfort of a person who is lightweight, but entirely unsuitable for the comfort of a considerably heavier person. Since standard sprung mattresses cannot be adjusted by the user, it may require trial and error to find a mattress with the correct level of support. Furthermore, conventional beds and mattresses require large amounts of materials to construct and can be expensive.

Hammocks are another well known form of furniture for seating or resting. However, hammocks are designed for brief periods of rest and are not intended for longer periods of comfortable sleep. A hybrid between a conventional bed and a hammock is proposed in U.S. Pat. No. 4,958,391, in which a mattress is suspended by ropes or chains. This is expected to be more comfortable than a hammock since a mattress is provided, but will still rely for comfort on the mattress.

SUMMARY OF THE INVENTION

According to the present invention, there is provided a bed comprising a frame and a mattress support, wherein the mattress support is suspended from the frame by a plurality of elastic supporting means.

Thus in accordance with the present invention a bed with improved comfort may be provided since the elastic supporting means provide greater elasticity to the bed than the mattress alone, as the elastic supporting means may stretch when weight is applied to the mattress thus supporting a proportion of the weight of the user on the bed.

The mattress support could be suspended so as to be able to sway freely in both lateral directions. Preferably, however, means are provided to reduce lateral sway in at least one direction. Preferably the elastic supporting means themselves are arranged to reduce the lateral sway of the mattress support, for example by being arranged to extend in opposite directions from a normal to the plane of the mattress support, between the mattress support and the frame. Such an arrangement of the elastic supporting means would serve to reduce the lateral sway of the mattress support since the elastic supporting means extending in one direction will apply a component of force opposing any force moving the mattress support in one lateral direction, and the elastic supporting means extending in the opposite direction to the first elastic supporting means will apply a component of force opposing any force moving the mattress support in the opposite direction to the first lateral direction.

In other words, having the elastic supporting means extending at an angle to the vertical allows them to apply a lateral and/or longitudinal restorative force as well as a vertical supporting force to the mattress support.

Preferably means are also provided to reduce lateral sway of the mattress support in the other direction. This could also be provided by the elastic supporting means, but preferably separate means are provided.

Preferably further means for damping lateral sway of the mattress are provided. For example, loops of elastic cord may pass around the upright members of the bed frame and through the mattress support at the four corners of the mattress support. This advantageously damps swaying motion of the mattress support in both lateral directions, preferably to prevent contact between the mattress support and the frame thus improving the comfort of the bed and also preventing injury to limbs of the person resting on the bed, which may overhang the edges of the mattress support. Moreover, the elastic loops can further help to avoid injury by physically preventing a limb or the like from being placed between the mattress support and the frame.

The elastic supporting means could comprise several separate cords or separate loops extending between the mattress support and the frame. This might allow the user to reduce or increase the number of cords attached to the mattress support, thereby reducing or increasing the amount of support provided by the bed.

Alternatively, at least some of the elastic supporting means are provided by a single length of elastic cord. This is advantageous because it allows the elastic cord to be attached to the frame and the mattress support easily, for example by wrapping the cord around the frame components, or by simply passing the cord underneath the mattress support and over the frame. This makes a simple construction of the bed possible.

More preferably, separate elastic cords are provided at opposite ends of the bed, since this arrangement avoids the need to have cord traversing the length of the bed. Preferably, the elastic supporting means are provided only at the opposite ends of the mattress support. This provides for easy access from either side of the bed, unhindered by any supporting means. However, it may be desirable in some circumstances to provide a bed with elastic supporting means around the sides and the ends of the bed, e.g. one intended for-a young child or infant. In this case, the elastic supporting means could also help to prevent the infant falling out of the bed at the sides or the ends.

The mattress support may be made in any convenient way and may be flexible. Preferably, however, the mattress support is substantially rigid. This ensures that any mattress placed on the mattress support will not be subject to twisting or bending forces which might make the mattress uncomfortable. The mattress support may comprise a frame and a plurality of boards or slats screwed to the frame. The mattress support may further comprise a head and/or a foot board.

The mattress support could be suspended by any convenient number of elastic supporting means, but preferably the mattress support is suspended by at least three elastic supporting means. This is advantageous since three is considered the minimum number of elastic supporting means that could be used on their own to suspend the mattress support. The mattress support may be suspended by the same number of elastic supporting means at the head end of the bed as at the foot end of the bed, or a larger number of elastic supporting means may be provided at the head end of the bed than at the foot end. In such an arrangement the head end of the mattress support can support a greater load than the foot end of the mattress support, which might be desirable for use since the upper half of an average person, which includes the head and upper torso, weighs more than the lower half of a person.

The mattress support could be acted upon solely by the aforementioned elastic supporting means. Preferably, however, the bed further comprises means for restraining upward movement of the mattress support. The upward restraining means could be inelastic, for example, a chain or a rope but is preferably elastic. This can give the advantage that any vertical oscillation of the mattress support can be damped. Preferably the upward restraining means also acts to restrain lateral movement of the mattress support in at least one direction, e.g. by extending in pairs in opposite directions, from the normal to the plane of the mattress support, between the mattress support and the frame. Most preferably, the elastic supporting means and the upward restraining means are arranged to reduce lateral movement of the mattress support in mutually orthogonal directions.

As with the elastic supporting means, the upward restraining means may comprise a plurality of elastic cords arranged between the frame and the mattress support. Preferably in such embodiments a pair of cords is provided on each side of the bed. Alternatively at least some of them comprise a single length of elastic cord, thus further simplifying the construction of the bed.

The upward restraining means could be provided at any convenient location, but preferably are provided at opposite sides of the mattress support.

In accordance with a particular preferred embodiment of the present invention, the elastic supporting means are provided only at the opposite ends of the mattress support and the elastic upward restraining means are provided only at the opposite sides of the mattress support. In this embodiment, movement of the mattress support can be provided by the supporting means and the upward restraining means without affecting access by the user to the bed.

To provide the bed with still further control over the movement of the mattress support, the bed is preferably provided with means for limiting downward movement of the mattress support. Advantageously, the downward limiting means can prevent overstretching of the elastic supporting means. Further they may prevent any space under the mattress support which may be required, for example for storage, from being overly compromised. Still further the downward limiting means may prevent the mattress support from undesirably hitting the floor.

The downward limiting means may take any convenient form e.g. a stop formed on the frame or one or more elastic ropes of greater strength than the elastic supporting means, but preferably the downward limiting means is substantially inelastic, e.g. a rope or a chain. This need not compromise the user's comfort since it is intended that the downward limiting means will only act as a backup in extreme circumstances to prevent damage to the bed.

It may be particularly desirable to limit the downward movement of the mattress support if the bed is occasionally or regularly intended for use by more than one person. If the weight of one of the people is greater than that of another, the bed may undesirably slope downward on the side of the heavier person. If at a later stage only one person uses the bed it may then be desirable to allow greater downward movement of the mattress support, thus allowing more vigourous movement of the mattress support in all directions.

Preferably, therefore, the downward limiting means is selectively engagable. For example, the downward limiting means may comprise a cord or chain provided on one of the frame and the mattress support, the cord or chain being removably engagable with the other of the frame and the mattress support.

Any suitable number and location of the downward limiting means may be provided, but preferably such limiting means are, provided at each corner of the mattress support.

The above described construction of a bed frame and suspended mattress support provides a bed with improved comfort that is simple in construction and requires considerably less materials thus substantially reducing manufacturing costs.

BRIEF DESCRIPTION OF THE DRAWINGS

Certain preferred embodiments of the present invention will now be described, by way of example only, with reference to the accompanying drawings, in which.

DETAILED DESCRIPTION OF THE PREFERRED EMBODIMENT

Figure 1:
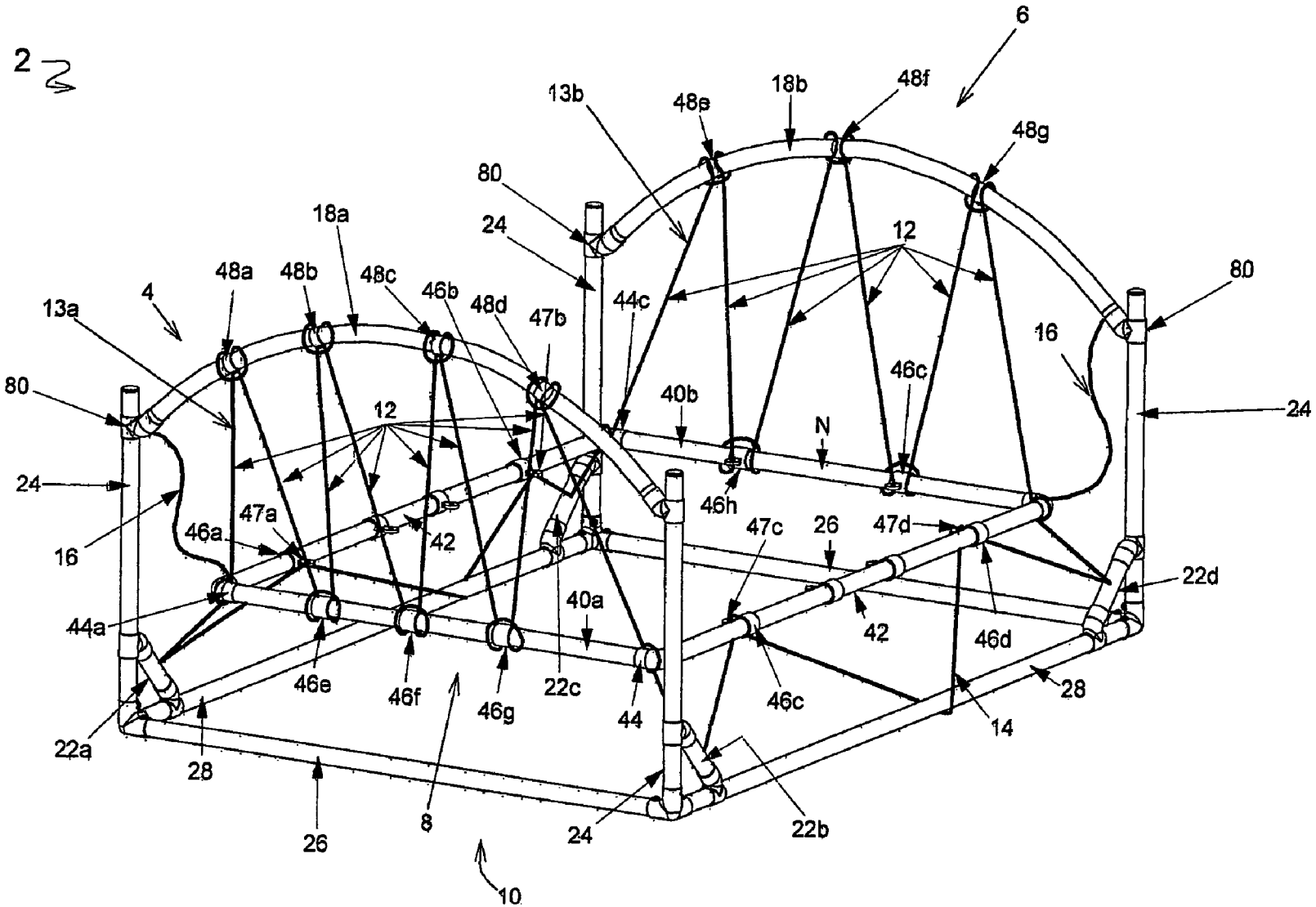
FIG. 1 shows in perspective a bed having supporting means and upward restraining means in accordance with a first embodiment of the present invention.

Referring to FIG. 1, a bed 2 in accordance with the invention is shown. The bed 2 generally comprises a frame, having a vertical head end portion 4 and a vertical foot end portion 6 which are connected by means of a base 10. A mattress support 8 is suspended from the frame by a number of elastic supporting means 12 which are provided by a pair of elastic bungee cords 13*a*, 13*b* (described in greater detail below).

The frame 4, 6, 10 is constructed from tubular members 18, 24, 26, 28 which are fastened together using tubular fasteners 80, both the tubular members and the fasteners being of the type generally known in structural pipe fitting applications such as those available from Kee Klamp® of Reading, UK. Diagonal cross-members 22 are provided at the lower corners of the bed 2 to provide additional strength. The mattress support 8 is also constructed from tubular members 40, 42 arranged in a rectangular shape and held together by tubular fasteners 44 at each of the four corners. The construction of the bed in this manner advantageously reduces the amount of materials needed, and so can substantially reduce the manufacturing costs of the bed.

The arcuate cross-bars 18*a*, 18*b* at the two ends of the frame 4, 6 are provided with metal rings 48*a-g* that encircle the cross-bars 18*a*, 18*b*, disposed at intervals along the length of each cross-bar 18*a*, 18*b*. The metal rings 48*a-d* fit the cross-bars 18*a*, 18*b* sufficiently tightly that the rings do not move laterally along the length of the cross-bars i.e. each ring is fixed in its lateral position. The mattress support 8 is also provided with similar rings 46*a-i* along all of its four tubular members 40, 42, arranged not to move laterally along the length of the members 40, 42. These metal rings 46*a-i* are further provided with circular protrusions 47*a-i*, which can be used for attaching the elastic bungee cords 13 or upward restraining means 14 (discussed below) and also can be used to support and attach a mattress platform (omitted for clarity) placed on the mattress support 8.

Considering the head end 4 of the bed shown in FIG. 1, starting from the left, a single length of bungee cord is attached at one end to the diagonal cross-member 22*a* between the upright 24 and base member 28 of the frame. The bungee cord 13*a* passes inside the mattress support 8, is looped once around the corner connector 44*a* and passes up to the arcuate cross-bar 18*a* at the top of the head end of the frame 4. Here the cord 13*a* is attached at a first point to the bar 18*a* by wrapping the cord 13*a* twice around the bar 18*a* and also once around itself. This forms a knot around the bar 18*a* and also around a metal ring 48*a* fixed to the bar 18*a*. The bungee cord 13*a* then passes down again to the mattress support 8 to be wrapped twice around the mattress support member 40*a* and also once around itself. This forms a knot around the bar 18*a* and also around a metal ring 46*e* fixed to the member 40*a*. The bungee cord 13*a* then passes back up towards the bar 18*a* to be knotted a second time to the bar 18*a* around the central ring 48*b*. When the bungee cord 13*a* has been knotted four times to the bar 18*a* and knotted three times to the mattress support member 40*a*, in this manner, it passes back inside the mattress support 8 where it is looped once around the corner connector 44*b* and is attached at its other end to the right-hand diagonal frame cross-member 22*b*. In total, the bungee cord 13*a* provides eight elastic supporting means 12.

The single length of bungee cord 13*b* at the foot end of the bed 6 is attached in a similar manner to the cord 13*a* at the head end 4, but provides fewer elastic supporting means 12. The ends of the cord 13*b* are attached to the diagonal cross-members 22*c* and 22*d* of the bed 2. The cord 13*b* passes inside the mattress support 8 and is looped once around each corner connector 44*c* and 44*d*. The cord 13*b* then passes to the arcuate cross-bar 18*b* of the foot end 6 of the bed 2 and is knotted three times to the bar 18*b* at the positions where metal rings 48*e-g* are attached to the bar 18*b*. The cord 13*b* is also knotted twice to the mattress support member 40*b*. In total, the foot end bungee cord 13*b* provides six elastic supporting means 12. Thus, in the embodiment of FIG. 1, it may be seen that the bungee cords 13*a*, 13*b* are arranged in pairs of elastic supports 12 with each pair extending between the mattress support 8 and the arcuate cross-bars 18*a*, 18*b* in opposite directions to the normal N to the plane of the mattress support 8. Each pair of elastic supports 12 therefore act to suspend the mattress but also act to apply force on the mattress support 8 in opposite lateral directions, thus improving the stability of the bed 2 and reducing lateral sway. The head end 4 of the bed is provided with a larger number of elastic supports than the foot end 9, so the head end 4 of the bed can carry a greater load than the foot end 6 of the bed. This ensures a more level sleeping surface.

In the embodiment of the invention depicted in FIG. 1, the bed 2 is further provided at its sides with means for restraining the upward movement of the mattress support 8, in the form of a pair of elastic cords 14 (for clarity of the figure, the elastic cord on the far side of the bed 2 is not shown). The ends of the single length of elastic cord 14 on the near side of the bed 2 are attached to the diagonal cross-members 22*b*, 22*d* on that side. The elastic cord 14 passes from one of the cross-members 22*b* towards the mattress support 8 and passes over a protrusion 47*c* that extend from a metal rings 46*c* attached to the mattress support tubular member 42. The elastic cord 14 then passes to the tubular member 28 of the side of the bed frame 10 where the elastic cord 14 passes under the tubular member 28 and then back towards the mattress support member 42. The elastic cord 14 passes over a second protrusion 47*d* that extends from a second metal ring 46*d*, before passing to the other diagonal cross-member 22*d* to which it is attached.

With this arrangement, upward movement of the mattress support 8 is opposed by the elasticity of the upward restraining means 14. The arrangement of the elastic cords 14 in pairs extending at opposite angles to the plane of the mattress support 8 also helps to reduce longitudinal sway of the bed.

In the embodiment of the invention depicted in FIG. 1, the bed 2 is further provided in its four corners with inelastic means for limiting downward movement of the mattress support 8, in the form of ropes 16 at each corner of the bed 2 (for clarity, only two of these are shown). The ropes 16 are of such a length that they do not become taut until the mattress support 8 is displaced downward far enough to stretch the sections of bungee cord 12 excessively. Thus, the ropes 16 prevent the mattress support 8 from lowering any further, and so prevent it from contacting with the floor or any item stored underneath the mattress support 8. The ropes 16 are attached to the four corner connectors 44*a-d* of the mattress support 8 and to corresponding corners of the frame at the ends of the arcuate cross-members 18*a*, 18*b*.

In use a platform is placed onto the protrusions 47*a-e* on the mattress support 8 and a mattress is placed on top of that. The bed may then be used as normal except that the elasticity of the supporting means 12 gives greater comfort. Oscillation of the mattress support 8 is damped by cooperation between the elastic supports 12 and the upward restraints 14. Furthermore, the arrangement of these in angled pairs limits lateral sway of the mattress support 8 in both orthogonal directions.

Figure 2:
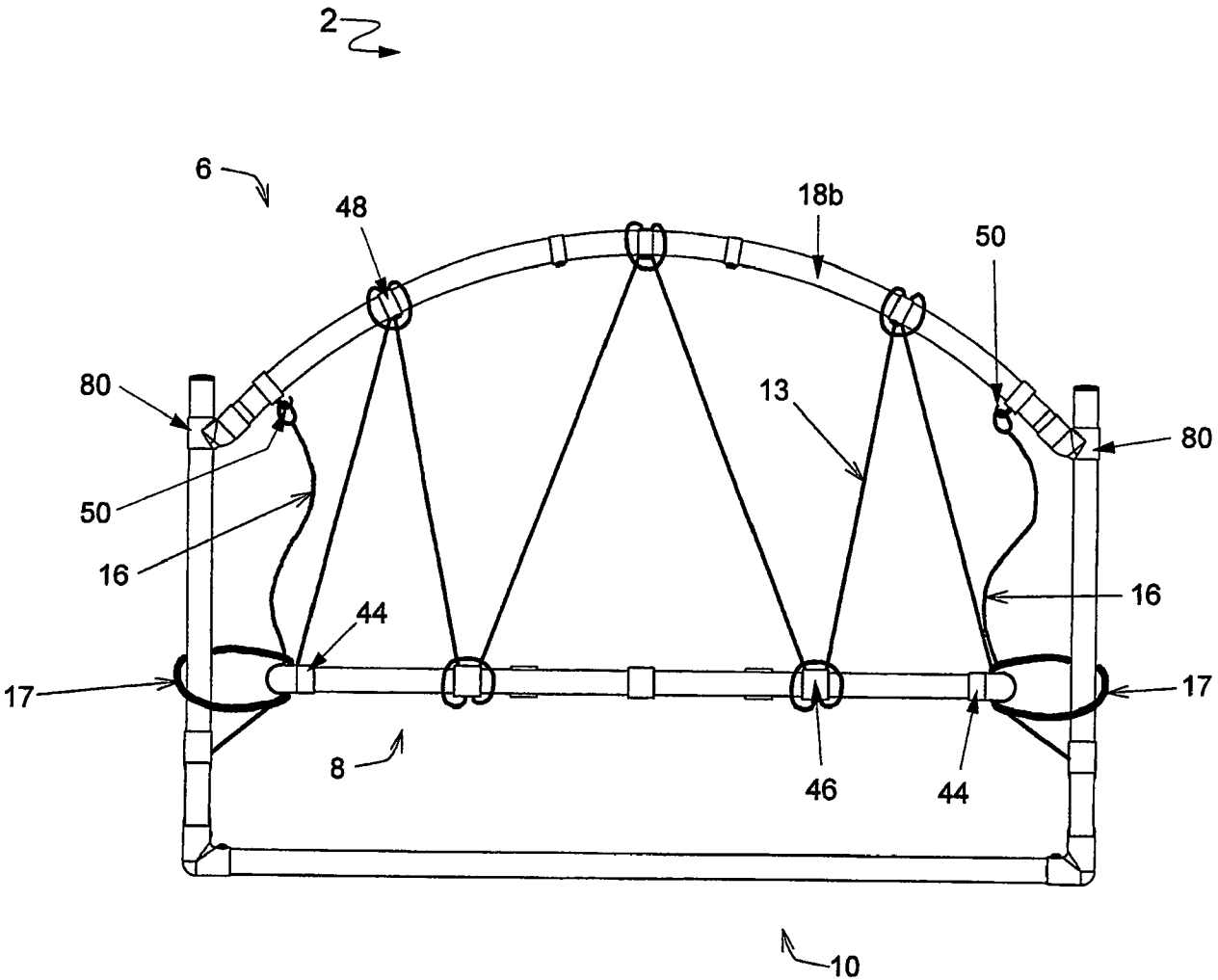
FIG. 2 shows a view of one end of a bed having supporting means and lateral limiting means in accordance with another embodiment the present invention.

Another embodiment is shown in FIG. 2, which is a view of the foot end 6 of the bed 2. The elastic bungee cord 13 shown in this embodiment is attached to the arcuate cross-bar 18 in the same manner to the cord 13*a* of the embodiment depicted in FIG. 1.

The embodiment of FIG. 2 differs from the first embodiment in that the downward limiting ropes 16 of this embodiment are attached to the arcuate cross-bar 18 in a different manner to those of the first embodiment. In FIG. 2, the ropes 16 are removably engagable with the cross-bar 18 by being looped over hooks 50 such that the ropes 16 can easily be removed should they not be required.

In the embodiment of the invention depicted in FIG. 2, the bed 2 is further provided in its four corners with means for further damping movement of the mattress support 8 in either lateral direction, in the form of loops of elastic cord 17. Each loop 17 is substantially ovoid and is arranged to encircle the mattress support 8 and the upright member 24 of the frame in one corner of the bed 2. The loop 17 passes through the mattress support 8 in the region of the corner connector 44 of the mattress support 8 and passes around the upright member 24 of the bed, thus joining the mattress support 8,to the upright member 24. One loop 17 is arranged at each of the four corners of the bed 2 such that the loops 17 are all under tension. The tension is sufficient to prevent contact between the mattress support 8 and the upright member 24 under normal loads.

With this arrangement, lateral movement of the mattress in both directions in reduced and thus the sway of the mattress support is considerably damped.

Figure 3:
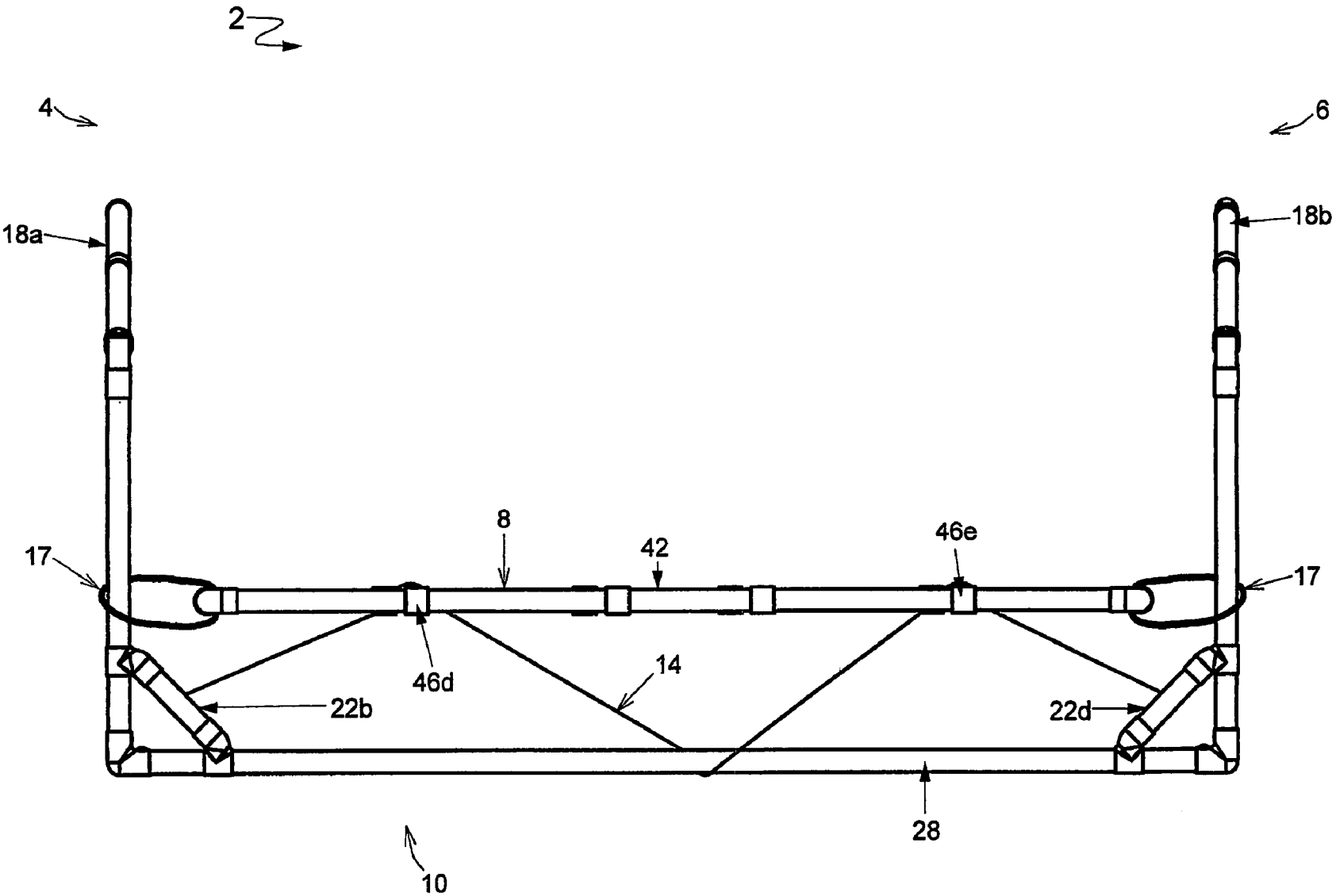
FIG. 3 shows a view of one side of a bed having upward restraining means and lateral limiting means in accordance with a further embodiment of the present invention.

A further embodiment is shown in FIG. 3, which is a side view of the bed. In this embodiment, upward restraining means is provided by an elastic cord 14 that is attached to the diagonal cross-members 22 at either end, and passes at several points over the tubular member 42 of the side of the mattress support 8 in a similar manner to the elastic cord of the first embodiment. The embodiment of the invention shown in FIG. 3 is further provided with loops of elastic cord 17 in a similar manner to the second embodiment.

Figure 4:
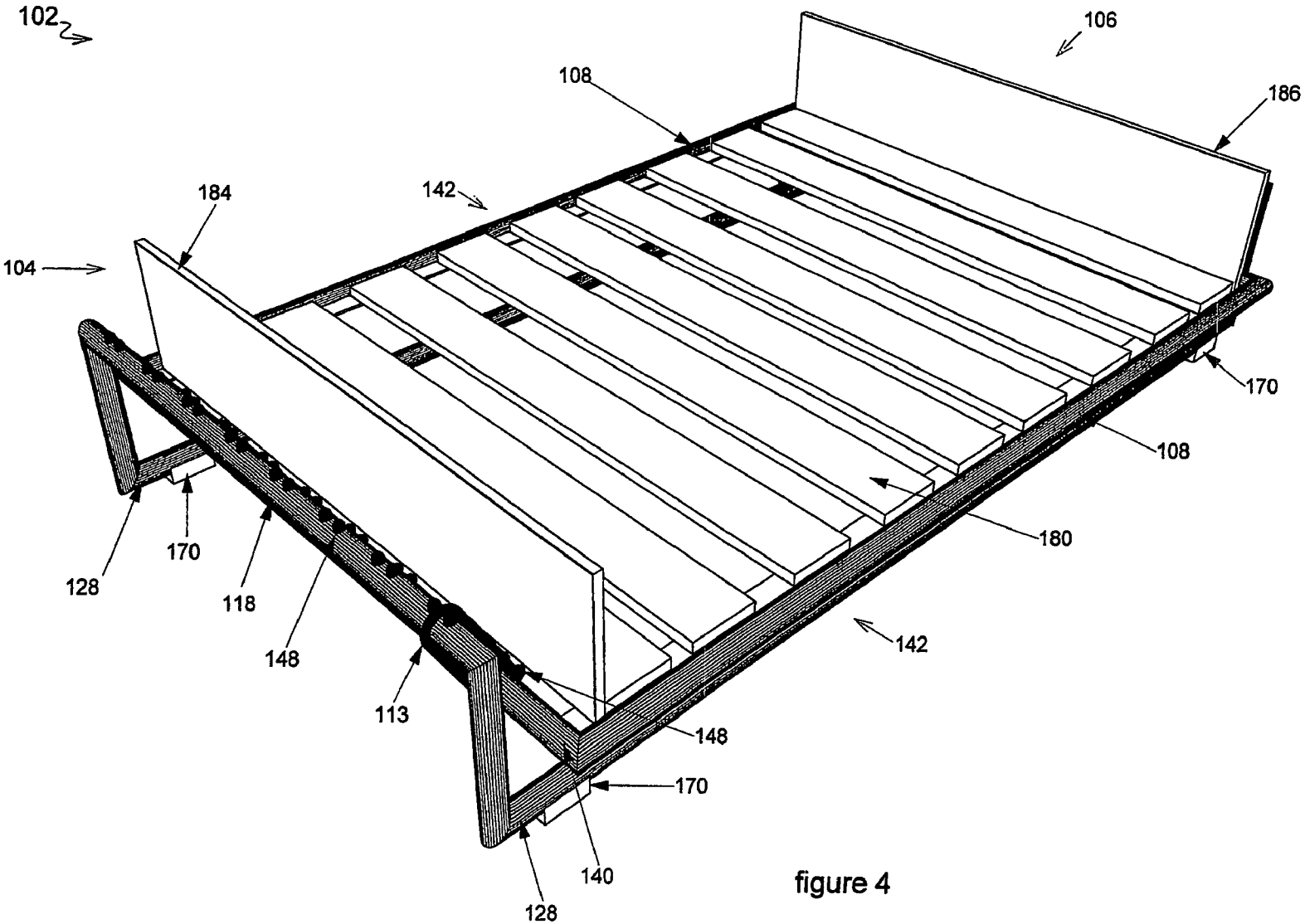
FIG. 4 shows in perspective a further alternative embodiment of a bed in accordance with the present invention.
Figure 5:
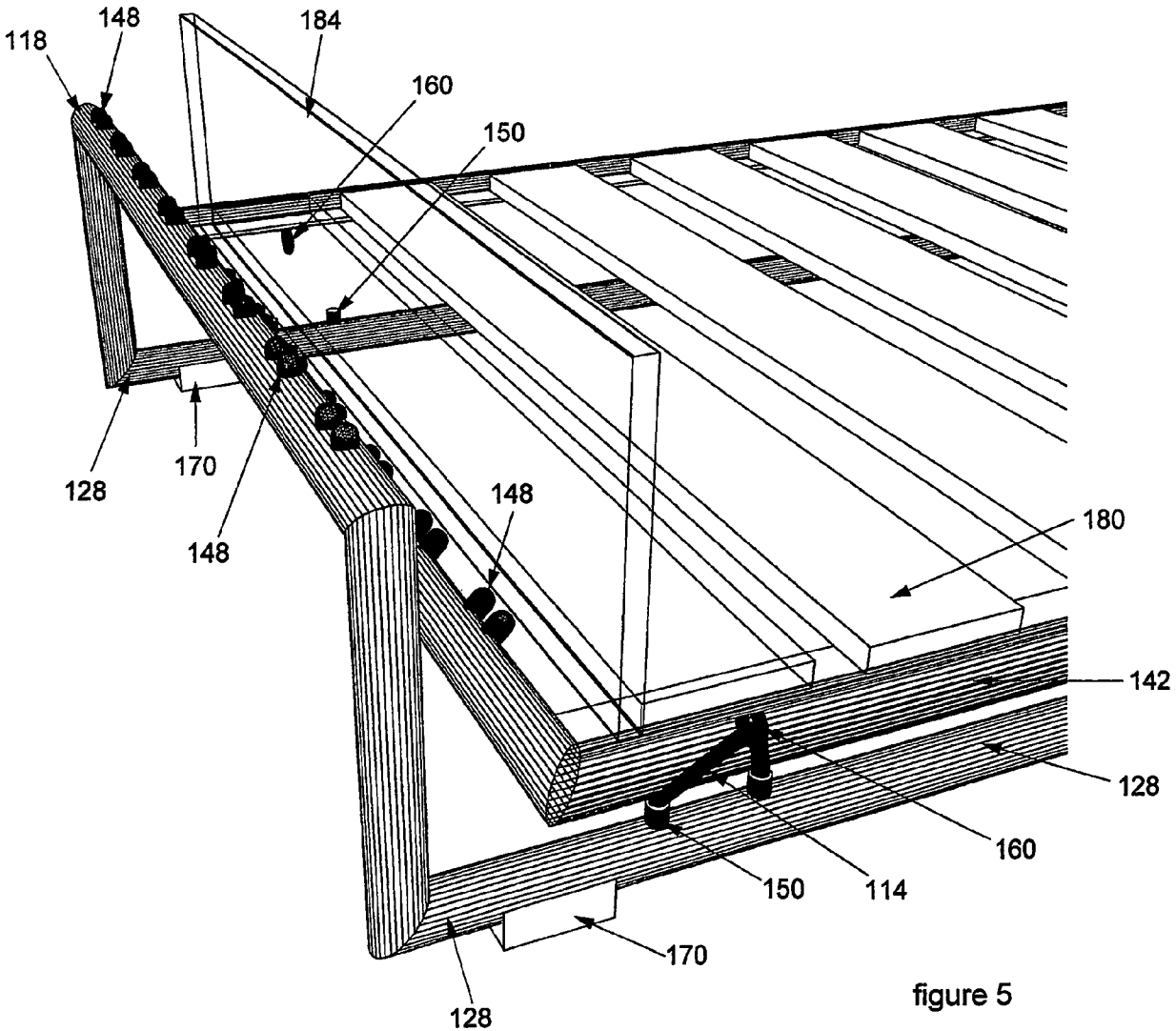
FIG. 5 shows an enlarged view of one end of the bed of FIG. 4, with the elastic supporting means removed for clarity.

Another alternative embodiment of a bed 102 in accordance with the present invention is shown in FIGS. 4 and 5. The embodiment of the invention depicted in FIGS. 4 and 5 differs from the previous embodiments in that the elastic supporting means comprises eight elastic loops 113 provided at each end of the mattress support 108 (in the Figures only one loop at the head end 104 is shown for clarity). The head 104 and foot 106 ends of the frame comprise horizontal bars 118 running parallel with the tubular members 140 of the frame at the head end and foot end of the bed 102. The horizontal bars 118 and the tubular members 140 are each provided with eight pairs of protrusions or bosses 148. These bosses are arranged in pairs such that there exists a gap between the two bosses 148 of each pair in which the elastic loop 113 can rest. Having a boss 148 either side of each loop 113 where it passes around the tubular member 140 and the horizontal bar 198 prevents the loop 113 from sliding along the length of either the tubular member 140 or the horizontal bar 118.

The bed 102 of this embodiment also comprises a pair of restraining means on either side of the bed comprising a pair of elastic cords 114 (shown in FIG. 5). Each cord 114 is attached at either end by passing through a pair of sleeves 150 on the tubular member 128 at the side of the bed frame and being knotted inside. In between the two sleeves 150 the elastic cord 114 passes through a ring 160 attached to and depending downwards from the side 142 of the mattress support 108. The bed of this further embodiment further comprises a pair of feet 170 at either end of the bed. The mattress support 108 comprises a plurality of boards or slats 180 running horizontally from edge to edge of the mattress support 108, onto which a mattress can be laid. The slats 180 are screwed to a flat bar welded at intervals to the tubular member of the mattress support 108 and are closely spaced to allow a standard mattress or a futon mattress to be placed on the mattress support 105. The support 108 also comprises a head 184 and a foot 186 board.

The outer frame of the bed 118, 128 breaks down into four components for ease of transportation and to allow the use of the pre-joined loops 113. The frame of the mattress support 108 can also break down into four parts. The joints of the bed are tungsten inert gas welded.

In a further alternative embodiment of the present invention (not shown) the bosses of the previous embodiment are replaced with laser cut units that provide guides for the elastic loops to fit into, such as parallel plates between which the loops fit. These plates can be welded to the frame.

It can be seen from the above that, particularly in its preferred embodiments, the present invention provides a bed with improved comfort, stability and support.

The invention claimed is:

1. A bed comprising a frame and a mattress support, wherein: the mattress support is suspended from the frame by a plurality of elastic supports and is capable of swaying freely relative to the frame in at least one lateral direction; and the bed further comprises elastic restraining means for damping the lateral sway of the mattress support in the at least one direction; and the elastic supports are provided by a plurality of loops of elastic.

2. A bed as claimed in claim 1 wherein at least one pair of elastic supports extend between the mattress support and the frame in opposite directions from a normal to the plane of the mattress support, to provide additional damping of the lateral sway.

3. A bed comprising a frame and a mattress support, wherein: the mattress support is suspended from the frame by a plurality of elastic supports and is capable of swaying freely relative to the frame in at least one lateral direction; and the bed further comprises elastic restraining means for damping the lateral sway of the mattress support in the at least one direction; and the elastic supports are provided only at the opposite ends of the bed.

4. A bed as claimed in claim 1 wherein the mattress support is substantially rigid.

5. A bed as claimed in claim 1 comprising at least three elastic supports.

6. A bed as claimed in claim 1 further comprising means for restraining upward movement of the mattress support.

7. A bed as claimed in claim 6 wherein the upward restraining means are elastic cord.

8. A bed as claimed in claim 6 wherein separate means for restraining upward movement are provided at opposite sides of the bed.

9. A bed as claimed in claim 8 wherein the elastic supports are provided only at the opposite ends of the bed and the elastic upward restraining means are provided only at the opposite sides of the bed.

10. A bed as claimed in claim 1 further comprising means for limiting downward movement of the mattress support.

11. A bed as claimed in claim 10 wherein the downward limiting means is substantially inelastic.

12. A bed as claimed in claim 10 wherein the downward limiting means comprises a cord or chain provided on one of the frame and the mattress support, the cord or chain being removably engaged with the other of the frame and the mattress support.

13. A bed as claimed in any one of claims 10 wherein the downward limiting means are provided at each corner of the mattress support.

14. A bed as claimed in claim 1 further comprising means for further limiting lateral movement of the mattress support.

15. A bed as claimed in claim 14 wherein the means comprise loops of cord or chain provided on the bed frame and on the mattress support at each corner.

16. A bed as claimed in claim 15 wherein the loops of cord are elastic.

17. A bed as claimed in claim 1 wherein the elastic supports are provided only at the opposite ends of the bed.

18. A bed as claimed in claim 1 wherein the mattress support is substantially rigid.

19. A bed comprising a frame and a mattress support, wherein: the mattress support is suspended from the frame by a plurality of elastic supports and is capable of swaying freely relative to the frame in at least one lateral direction; and the bed further comprises elastic restraining means for damping the lateral sway of the mattress support in the at least one direction; and at least some of the elastic supports are provided by a single length of elastic cord.

20. A bed as claimed in claim 19 wherein separate elastic cords are provided at opposite ends of the bed.

21. A bed as claimed in claim 19 wherein at least one pair of elastic supports extend between the mattress support and the frame in opposite directions from a normal to the plane of the mattress support, to provide additional damping of the lateral sway.

22. A bed as claimed in claim 19 further comprising means for restraining upward movement of the mattress support.

23. A bed as claimed in claim 22 wherein said means for restraining upward movement are elastic cord.

24. A bed as claimed in claim 22 wherein separate means for restraining upward movement are provided at opposite sides of the bed.

25. A bed as claimed in claim 24 wherein the elastic supports are provided only at the opposite ends of the bed and the elastic upward restraining means are provided only at the opposite sides of the bed.

* * * * *